US010625962B2

(12) United States Patent
Alagos et al.

(10) Patent No.: US 10,625,962 B2
(45) Date of Patent: Apr. 21, 2020

(54) VARIABLE SEPARATION PADS BASED ON LIFT HEIGHT, AND METHODS TO ROTATE OR CURVE THE PADS

(71) Applicant: Lexmark International, Inc., Lexington, KY (US)

(72) Inventors: Angel Macuha Alagos, Liloan (PH); Edmund Hulin James, III, Lexington, KY (US); Stacey Vaughan Mitchell, Lexington, KY (US); Chad Michael Piening, Lexington, KY (US); Louann Behymer Samuels, Georgetown, KY (US); Curtis Duane Woodson, Georgetown, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/038,582

(22) Filed: Jul. 18, 2018

(65) Prior Publication Data

US 2020/0024091 A1 Jan. 23, 2020

(51) Int. Cl.
*B65H 1/24* (2006.01)
*B65H 1/26* (2006.01)

(52) U.S. Cl.
CPC ..... *B65H 1/24* (2013.01); *B65H 1/266* (2013.01)

(58) Field of Classification Search
CPC . B65H 1/08; B65H 1/24; B65H 1/266; B65H 3/5223; B65H 3/56; B65H 2405/113; B65H 2405/1134; B65H 2405/1136
USPC ..... 271/167
See application file for complete search history.

(56) References Cited

U.S. PATENT DOCUMENTS 6,059,282 A * 5/2000 Jang ..... B65H 3/56 271/160
8,757,612 B2 * 6/2014 Tsai ..... B65H 3/34 271/121
2008/0211169 A1 * 9/2008 Klein ..... B65H 3/0661 271/167

* cited by examiner

*Primary Examiner* — David H Bollinger

(57) ABSTRACT

Separation strips in a dam aid in the separation of adjacent sheets of media being fed from a stack of sheets so that only one sheet is fed to a process station and, more particularly, to separating the uppermost or top sheet of a stack of sheets from the next adjacent sheet during feeding of the top sheet from the stack of sheets of media. When a lift plate is present that adjusts the height of the media stack, rotation of the separation strips to maintain a constant separation angle improves media feed reliability. Curvature of the separation strips may also maintain the separation angle as the lift plate raises the position of the top media sheet.

3 Claims, 7 Drawing Sheets

VARIABLE SEPARATION PADS BASED ON LIFT HEIGHT, AND METHODS TO ROTATE OR CURVE THE PADS

FIELD OF THE INVENTION

This invention relates to separation strips in a dam for separating adjacent sheets of media being fed from a stack of sheets so that only one sheet is fed to a process station and, more particularly, to separating the uppermost or top sheet of a stack of sheets from the next adjacent sheet during feeding of the top sheet from the stack of sheets of media.

BACKGROUND OF THE INVENTION

One problem in feeding media from a stack of sheets of media is that the sheets may stick together and at least the next adjacent sheet may be fed at the same time. Accordingly, various separating means have been suggested for separating a top sheet of a stack of sheets of media from the next adjacent sheet when the feed is from the top of the stack of sheets of media and for separating a bottom sheet of a stack of sheets of media from the next adjacent sheet when the feed is from the bottom of the stack of sheets of media.

It is known to separate a top sheet of a stack of sheets from the next adjacent sheet through using a dam, which is an element having an inclined surface in the path of the top sheet, as it is fed from the stack of sheets, so that its leading edge will strike the inclined surface of the element.

In a printer, however, the advancement of more than one sheet from the stack of sheets can cause jamming. Therefore, it is necessary to avoid simultaneous advancement of more than one sheet from a stack of sheets of media to a processing station such as a printer, for example, particularly where a lift plate changes the angle of incident of the sheets of media as the quantity of sheets decrease during operation with each subsequent sheet fed.

SUMMARY OF THE INVENTION

Currently, because separation strips are flat, as the media is lifted in the tray, a concomitant change in the pick angle (the angle of the media when the printer "pick" mechanism advances a single sheet), which will then change the "separation angle," i.e., the angle the media intersects, or "hits," the separation system. The changing pick angle leads to inconsistent separation of the media as the lift plate moves from tray full to tray empty.

This invention maintains the angle of the media to the separation system throughout the stack height by either actively rotating separation strips as the plate is lifted or is passively achieved by using a curved separation strip surface.

The separation strips rotate at an angle relative to the lift plate to maintain a constant separation angle throughout the media stack height. The separation strips and any other features that are critical to picking and separation could be rotated together to maintain consistent media picking. The rotation of the separation strips may be accomplished using different methods. In one embodiment, gear linkage is used to rotate the strips as the lift plate is lifted. In a second embodiment, the separation strips are rotated independent of the lift plate based on feedback from the printer elements, such as the lift plate motor encoders. In a third embodiment, separation strip surfaces are curved such that the changed incident angle of the media due to the curvature will match the lift plate angle. As the media is lifted, the separation strips curve in toward the media.

An object of this invention is to keep the separation strips at the same relative angle as the lift plate to maintain consistent separation capability of the system and improve media feed reliability.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
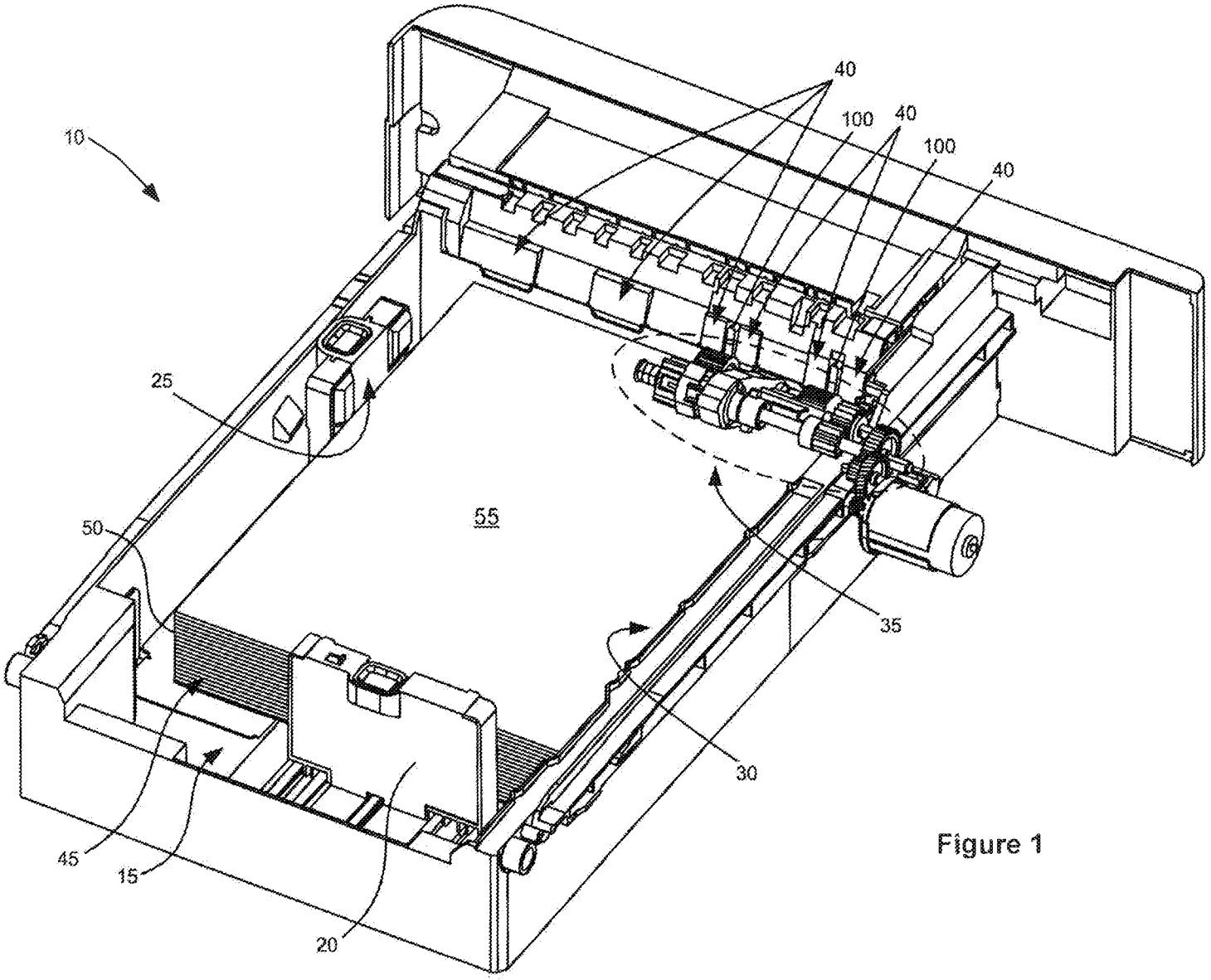
FIG. 1 is a perspective view of a printer tray having separation strips of the present invention with a stack of sheets of media therein and shown enlarged for clarity purposes.
Figure 2:
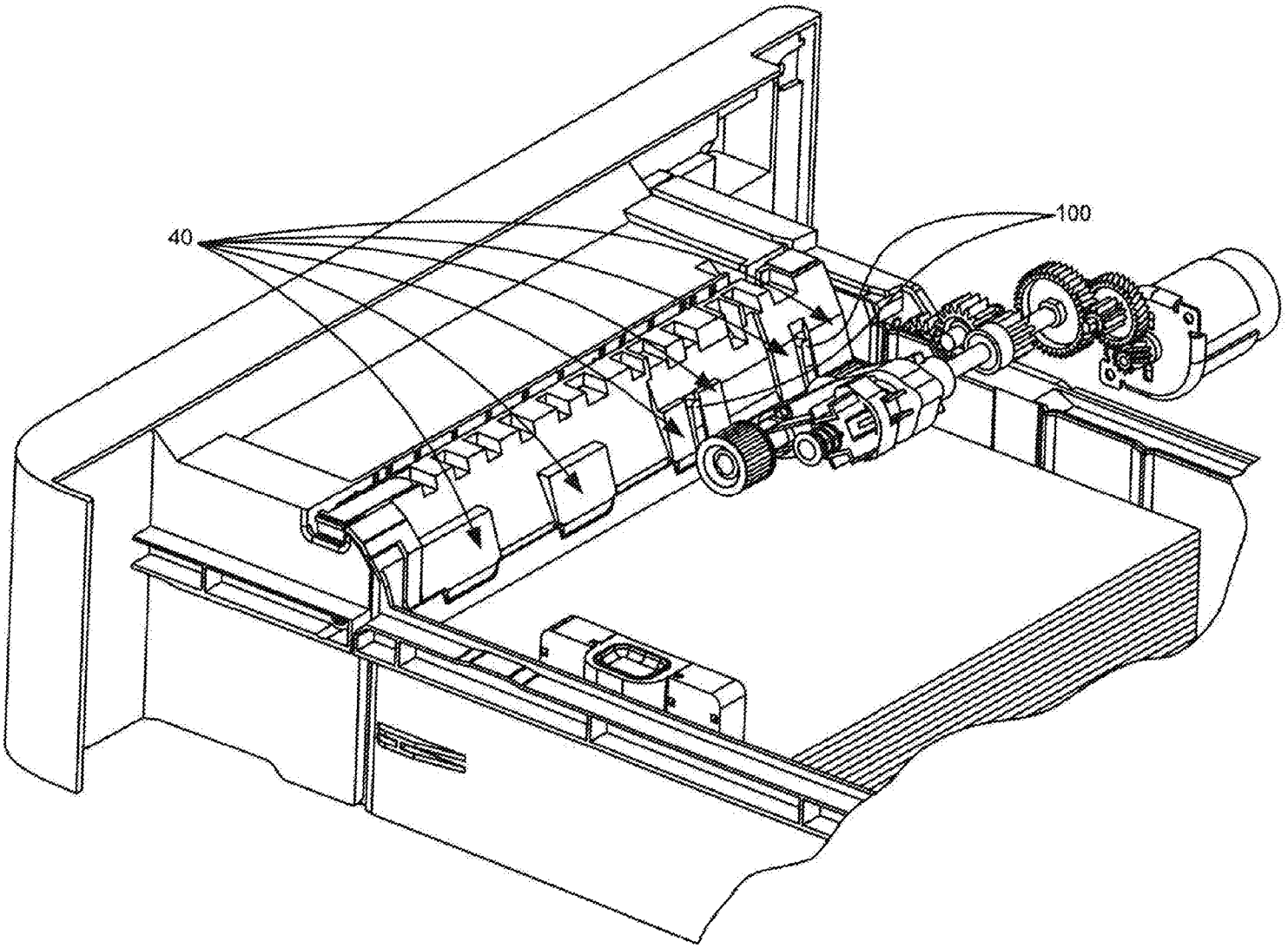
FIG. 2 is an enlarged perspective view of a portion of the tray of FIG. 1 and taken from the opposite side of FIG. 1.

Referring to the drawings, and particularly to FIGS. 1 and 2 thereof, there is shown a tray 10 used in a printer (not shown). The tray 10 supports a plurality of sheets 45 of a media such as bond paper, for example, in a stack 50. The sheets 45 may be other media such as labels or envelopes, for example.

The tray 10 has a bottom surface or wall 15 supporting the stack 50 of the sheets 45 therein. The tray 10 has a rear restraint 20 abutting a trailing edge of each of the sheets 45 of the stack 50. Adjacent its front end 12, the tray 10 has an inclined surface or dam 40 integral with the bottom surface 15 of the tray 10.

The dam 40 is inclined at an obtuse angle to the bottom surface 15 of the tray 10 and to the adjacent end of the stack 50 of the sheets 45. The dam 40 is a portion of a surface against which each of the sheets 45 in the stack 50 is advanced into engagement. The sheets 45 are advanced towards a processing station (not shown) at which printing occurs.

Each of the sheets 45 is advanced from the stack 50 by an auto-compensating mechanism ("ACM") 35, or similar mechanism known to persons of ordinary skill in the art, movable through an operating range including a starting angular position and an ending angular position.

Figure 3:
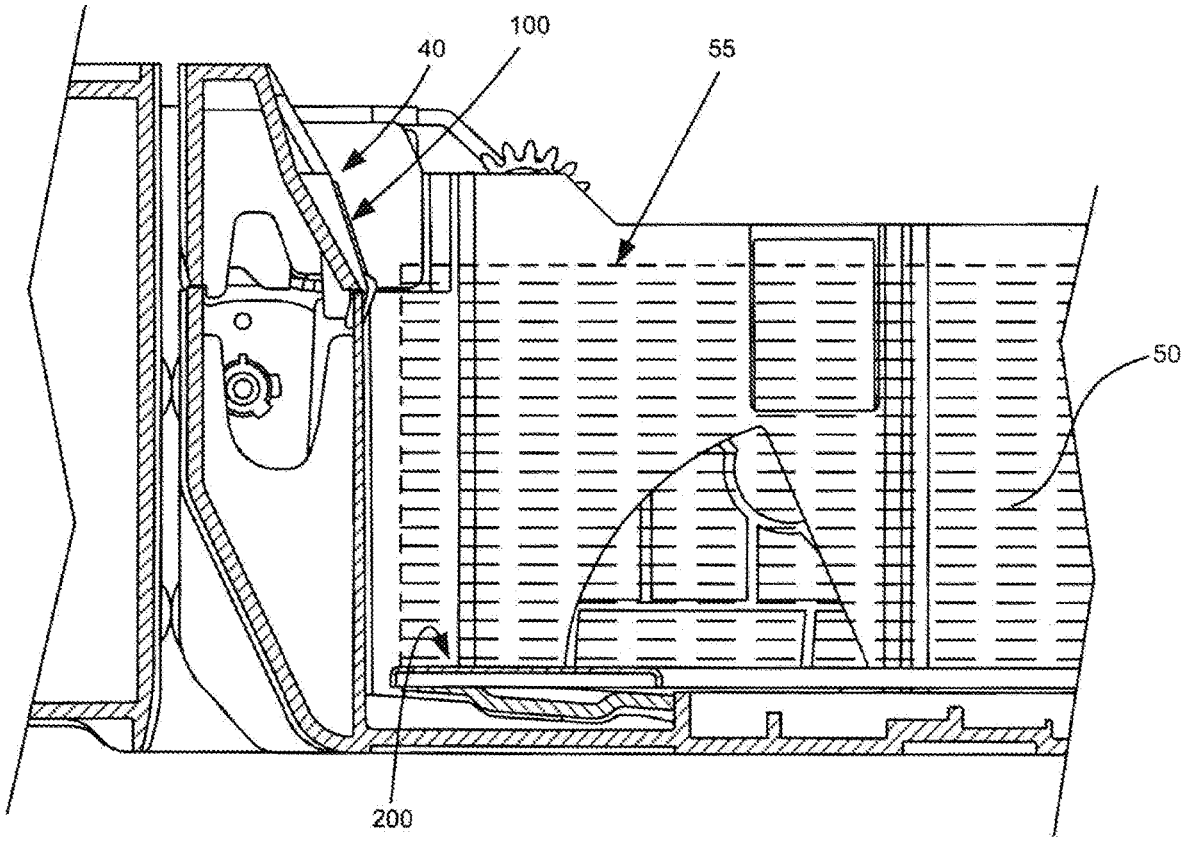
FIG. 3 is an enlarged fragmentary plan view of a portion of the dam of FIG. 1 showing the separation strips and lift plate in the tray full position.
Figure 3A:
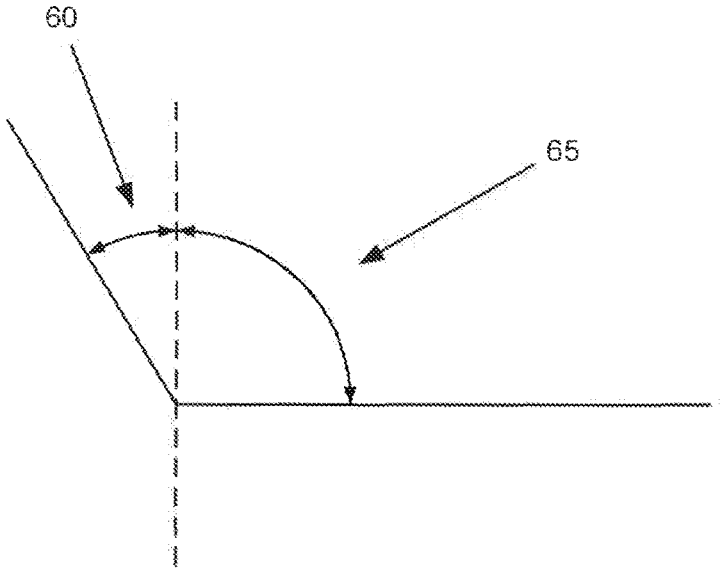
FIGS. 3A, 4A, and 5A show the angles of the separation strips and lift plate, and thus the top sheet of paper in the stack, after the lift plate and separation pads have rotated through exemplary angles of 5° and 10° corresponding to a quantities of paper depleting during normal operation.
Figure 4:
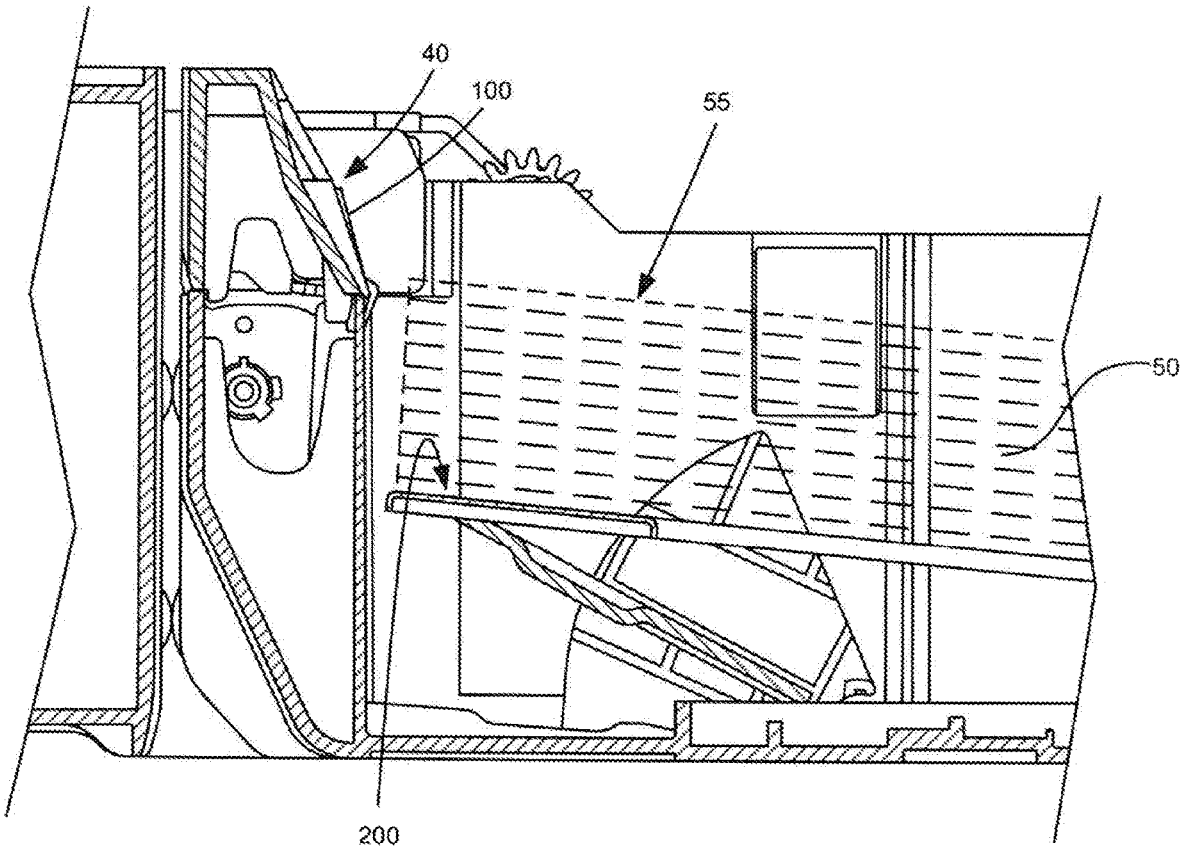
FIGS. 4 and 5 are enlarged fragmentary side views of a portion of the dam of FIG. 1 showing the separation strips and lift plate after the lift plate and separation pads have rotated through angles corresponding to a quantities of paper depleting during normal operation.
Figure 4A:
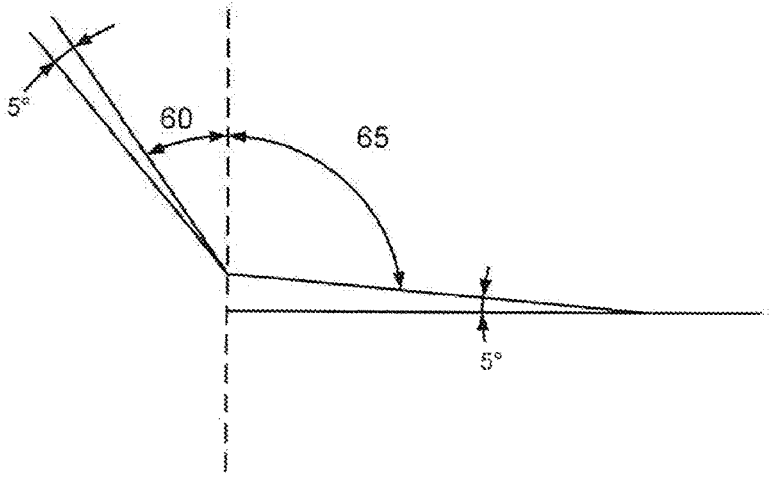
Figure 5:
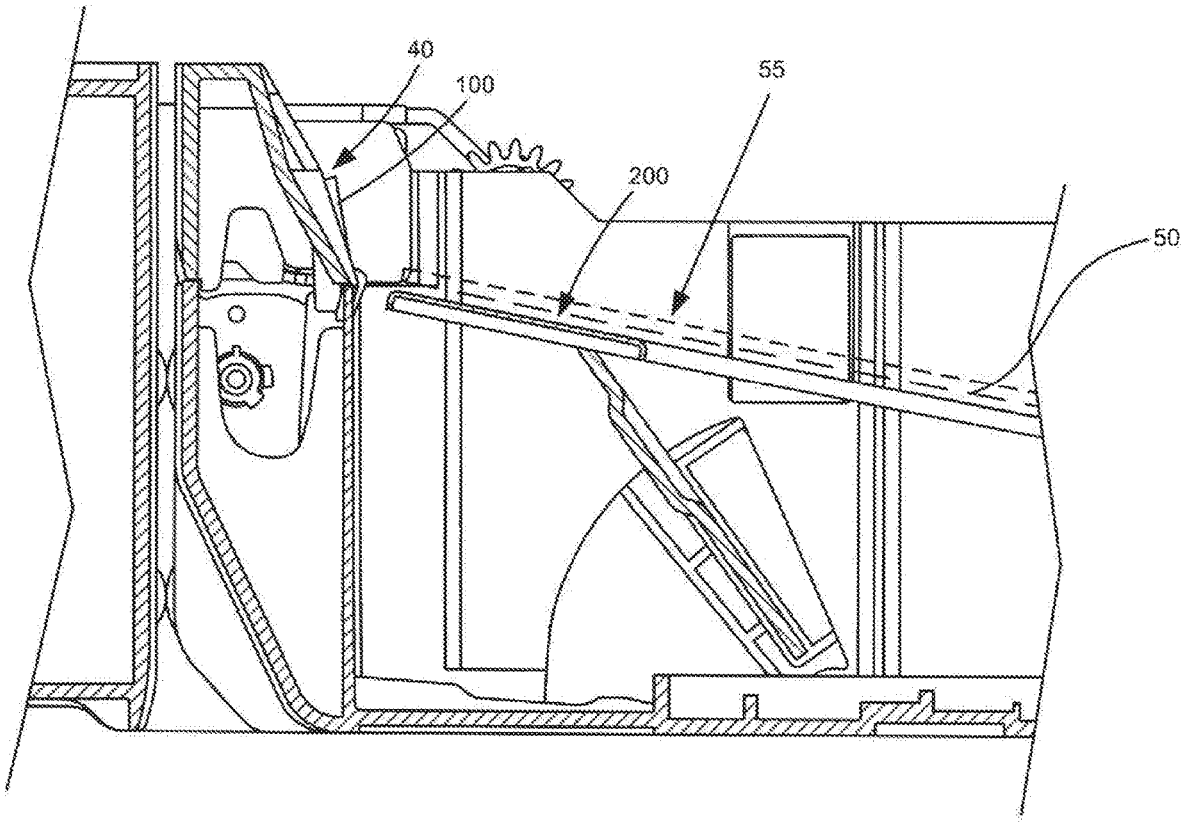
Figure 5A:
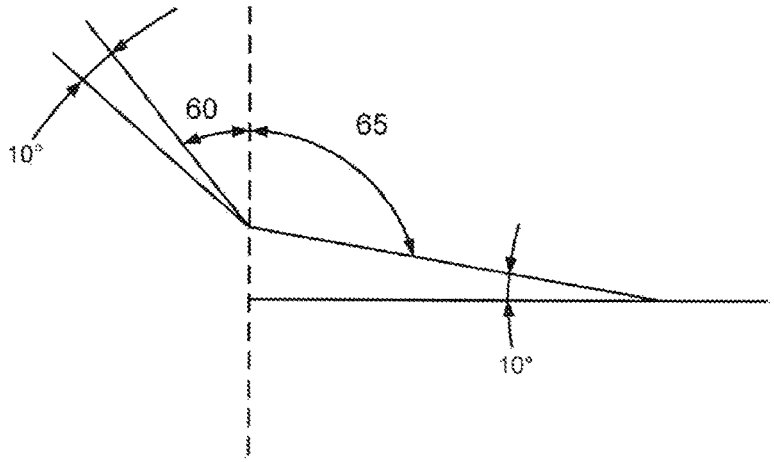

With reference to FIGS. 3, 4, and 5, the separation strips 100, preferably a thermoplastic polyurethane elastomer such as Pellethane®, rotate through exemplary angles of 5° and 10° as the lift plate 200 raises the media. The separation strips 100 rotate at the same angle as the lift plate to ensure the angle between the separation strips 100 and the lift plate 200 (the "separation angle") remains constant throughout the media stack 50 height. FIGS. 3A, 4A, and 5A show the the separation strips angle 60 and lift plate angle 65, and thus the angle of the top sheet of paper in the stack, after the lift plate and separation pads have rotated corresponding to a quantities of paper depleting during normal operation.

The separations strips 100 and any other features that are critical to picking and separation could be rotated together to maintain picking consistency.

The rotation of the separation strips 100 may be accomplished using different methods. Gear linkage (not shown) could be used to rotate the separation strips 100 through the same gear linkage as the lift plate 200 while the lift plate 200 is lifted. Further, the separation strips 100 could also be rotated independent of the lift plate 200 based on information such as lift plate motor encoders.

Figure 6:
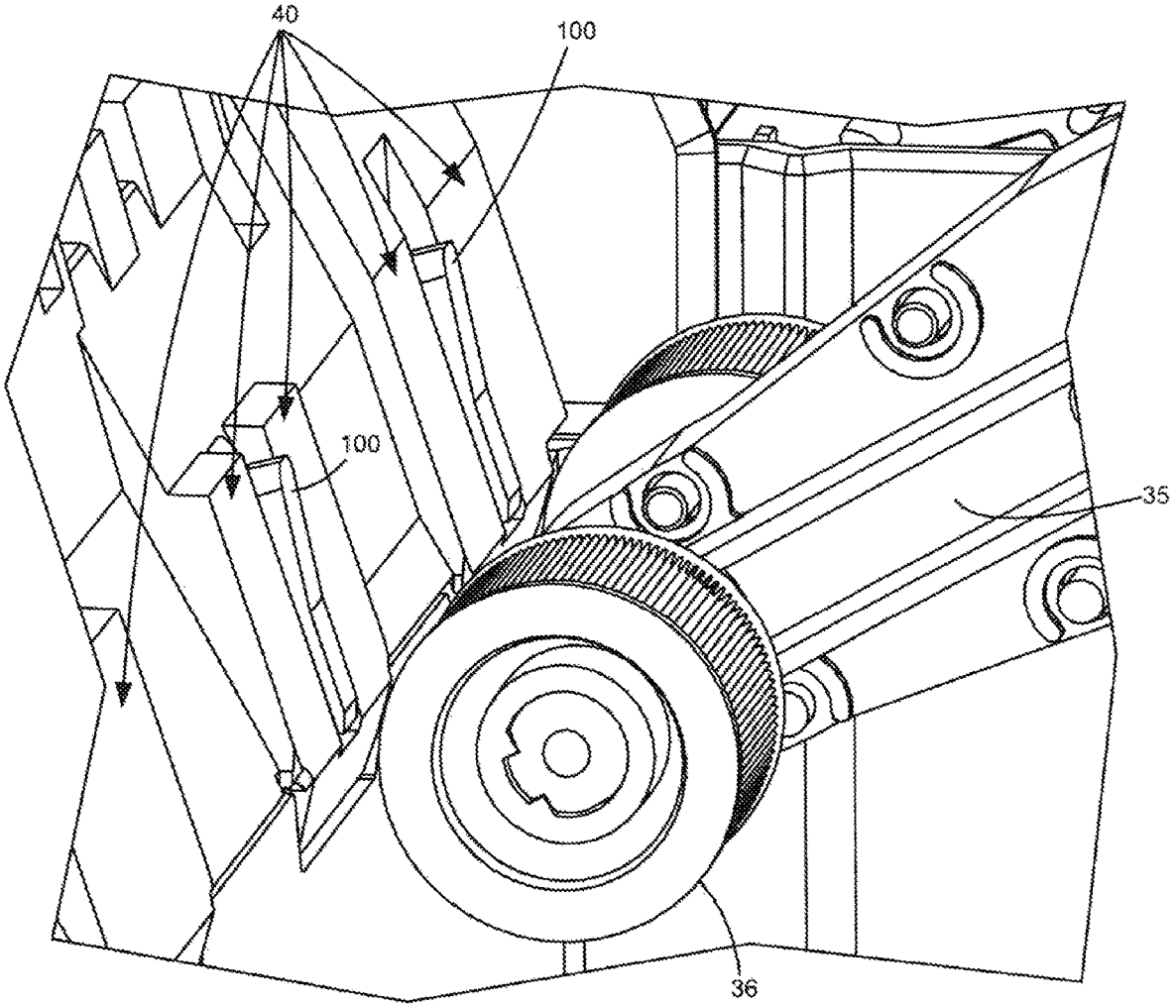
FIG. 6 is an enlarged fragmentary plan view of a portion of the dam of FIG. 1 showing the separation strips and separating dam surface rotated to the same angle relative to the lift plate to ensure the separation angle remains the same throughout the stack height.

With reference to FIG. 6, another embodiment to maintain the separation angle is to curve the separation strip 100 surface so that the relative angle will match the lift plate angle. As the media is lifted, the separation strips 100 will curve more in the media. Here, the lift plate 200 does not keep the leading edge of the top media sheet 55 (FIG. 1) in a constant position with respect to the separation strips 100, but controls the position of the lift plate 100 by the location of the ACM 35 tires 36. Since the tires 36 are back from the dam 40 some distance, the location of the media stack 50 to the dam 40 does move throughout the media stack 50. By changing the profile angle of the separation pads 100 based on position of the lift plate, a more consistent separation angle can be achieved.

Figure 7:
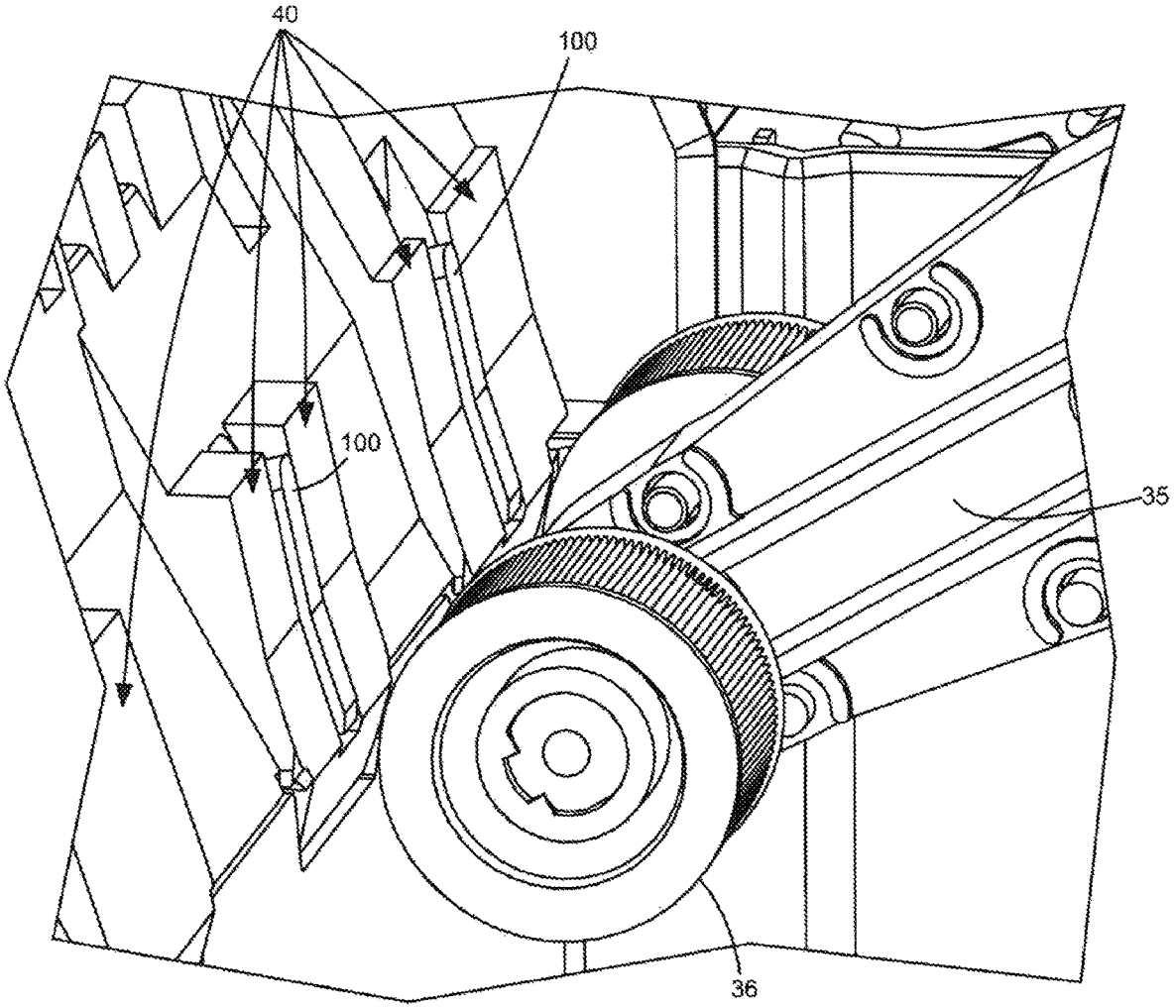
FIG. 7 is an enlarged fragmentary plan view of a portion of the dam of FIG. 1 showing the changing angle of the separation strips while the separating dam surface maintains a constant angle.

With reference to FIG. 7, another embodiment to maintain the separation angle is through rotation of both the separation strips 100 and the dam 400 at an angle relative to the lift plate 200 to maintain the separation angle throughout the stack height. In this embodiment, the profile of the dam 400 matches the profile of the separation strips 100.

While the separation strips 100 of the present invention has been shown and described as being used with a printer, it should be understood that the separation strips 100 of the present invention may be used with any apparatus feeding a sheet 55 from a media stack 50 to a processing station, for example, in which only one sheet at a time is to be fed from the stack to the processing station.

An advantage of this invention is that it is relatively inexpensive to manufacture, being made of a simple material. A further advantage of this invention is that it is very durable, especially if the separation strips 100 are made of Pellethane®. A still further advantage of the present invention is that it is easy to repair or replace if it malfunctions. Another additional advantage of this invention is that it can be used in a printer tray containing a large number of sheets of media.

For purposes of exemplification, particular embodiments of the invention have been shown and described according to the best present understanding thereof. However, it will be apparent that various changes and modifications in the arrangement and construction of the parts thereof may be made without departing from the spirit and scope of the invention as defined in the appended claims.

What is claimed is:

1. An apparatus for maintaining a separation angle of a media stack with respect to a dam in a printer media tray comprising:

a printer;

a media tray;

a lift plate in the media tray for lifting a media stack;

a dam adjacent the front end of the media tray;

at least one separation strip in the dam; and gear linkage in the media tray for raising the lift plate as the media stack is depleted that rotates the separation strips in the dam such that the separation angle between the lift plate and the separation strips remains constant, wherein the dam rotates with the separation strips.

2. An apparatus for maintaining a separation angle of a media stack with respect to a dam in a printer media tray comprising:

a printer;

a media tray;

a lift plate mechanism in the media tray for lifting a media stack;

a dam adjacent the front end of the media tray;

at least one separation strip in the dam; and gear linkage in the media tray for rotating the separation strips in the dam such that the separation angle between the lift plate and the separation strips remains constant that, is controlled by motor encoders in the lift plate mechanism, wherein the dam rotates with the separation strips.

3. A method of adjusting a separation angle between a top media sheet and at least one separation strip in a printer comprising:

rotating a lift plate positioned beneath a media stack in a media tray to alter an angle of incident between a top media sheet and the dam when the top sheet is picked by an auto-compensator mechanism during the paper feeding operation; and rotating the at least one separation strip in the dam through an angle to maintain a constant separation angle between the top media sheet and the at least one separation strip, wherein a gear linkage controlled by motor encoders in the lift plate mechanism is used to rotate the at least one separation strip in the dam such that the separation angle between the lift plate and the at least one separation strip remains constant.

* * * * *